US009423728B2

(12) United States Patent
Yamagishi et al.

(10) Patent No.: US 9,423,728 B2
(45) Date of Patent: Aug. 23, 2016

(54) FIXING DEVICE COMPRISING REFLECTING MEMBER ARRANGED BETWEEN HEAT SOURCE AND SUPPORTING MEMBER AND IMAGE FORMING APPARATUS INCLUDING THE SAME

(71) Applicant: KYOCERA Document Solutions Inc., Osaka (JP)

(72) Inventors: Yoshihiro Yamagishi, Osaka (JP); Yoshiharu Kanematsu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/781,486

(22) PCT Filed: Jan. 21, 2015

(86) PCT No.: PCT/JP2015/051535

§ 371 (c)(1),
(2) Date: Sep. 30, 2015

(87) PCT Pub. No.: WO2015/151554

PCT Pub. Date: Oct. 8, 2015

(65) Prior Publication Data

US 2016/0132001 A1 May 12, 2016

(30) Foreign Application Priority Data

Mar. 31, 2014 (JP) ..... 2014-072987

(51) Int. Cl.
*G03G 15/20* (2006.01)

(52) U.S. Cl.
CPC ..... *G03G 15/2007* (2013.01); *G03G 15/206* (2013.01); *G03G 15/2053* (2013.01); *G03G 2215/2035* (2013.01)

(58) Field of Classification Search
CPC ..... G03G 15/2017; G03G 15/2053; G03G 15/2064; G03G 15/2007; G03G 2215/2016; G03G 2215/2025; G03G 2215/2035
USPC ..... 399/328, 329, 336; 219/216
See application file for complete search history.

(56) References Cited

U.S. PATENT DOCUMENTS 8,953,994 B2 2/2015 Iwaya et al.
9,164,443 B2 * 10/2015 Shimokawa ..... G03G 15/2053

(Continued)

FOREIGN PATENT DOCUMENTS

JP 2010-20244 A 1/2010
JP 2010-078839 A 4/2010

(Continued)

OTHER PUBLICATIONS

International Search Report issued in Application No. PCT/JP2015/051535 mailed Feb. 24, 2015.

(Continued)

*Primary Examiner* — Robert Beatty
(74) *Attorney, Agent, or Firm* — Studebaker & Brackett PC

(57) ABSTRACT

A fixing device according to the present invention includes a fixing belt (22), a pressuring member (23), a heat source (24), a reflecting member (25) reflecting the radiant heat radiated from the heat source (24) to an inner circumference face of the fixing belt (22), a pressing member (27) pressing the fixing belt (22) to a side of the pressuring member (23) and a supporting member (26) supporting the pressing member (27). The reflecting member (25) is arranged between the heat source (24) and the supporting member (26) and configured to be curved or bent so as to project toward a side of the heat source (24). Straight lines (L) connecting a center (Z) of the heat source (24) with both end parts of the supporting member (26) in a conveying direction of a recording medium pass through the reflecting member (25).

12 Claims, 10 Drawing Sheets

(56) References Cited

U.S. PATENT DOCUMENTS

| | | | | |
|---|---|---|---|---|
| 2011/0158718 | A1 | 6/2011 | Fujiwara et al. | |
| 2013/0064586 | A1 | 3/2013 | Adachi et al. | |
| 2013/0195525 | A1* | 8/2013 | Yoshinaga | G03G 15/2053 399/329 |
| 2013/0216285 | A1 | 8/2013 | Miyauchi et al. | |
| 2014/0093288 | A1* | 4/2014 | Naitoh | G03G 15/2053 399/329 |

FOREIGN PATENT DOCUMENTS

| | | | | |
|---|---|---|---|---|
| JP | 2011-095539 | A | | 5/2011 |
| JP | 2011-197156 | A | | 10/2011 |
| JP | 2013-061417 | A | | 4/2013 |
| JP | 2013-145288 | A | | 7/2013 |
| JP | 2013145288 | A | * | 7/2013 |
| JP | 2013164438 | A | * | 8/2013 |
| JP | 2013164442 | A | * | 8/2013 |
| JP | 2013-178511 | A | | 9/2013 |

OTHER PUBLICATIONS

Written Opinion issued in Application No. PCT/JP2015/051535 mailed Feb. 24, 2015.

* cited by examiner

FIXING DEVICE COMPRISING REFLECTING MEMBER ARRANGED BETWEEN HEAT SOURCE AND SUPPORTING MEMBER AND IMAGE FORMING APPARATUS INCLUDING THE SAME

TECHNICAL FIELD

The present invention relates to a fixing device configured to fix a toner image onto a recording medium and an image forming apparatus including the fixing device.

BACKGROUND ART

Conventionally, an electrographic image forming apparatus, such as a copying machine, a printer, a facsimile or a multifunction peripheral includes a fixing device configured to fix a toner image onto a recording medium, such as a sheet. For the fixing device, a heat roller manner is widely used. The heat roller manner is a manner to form a fixing nip by using a pair of rollers.

On the other hand, a fixing manner is being shifted from the above-mentioned heat roller manner to a belt manner to reduce a heat capacity of the fixing device and to shorten a warm-up time. The belt manner is a manner to form a fixing nip by using a fixing belt.

For example, Patent Document 1 discloses a fixing device including a fixing belt, a pressuring member (see "pressuring roller 22" of Patent Document 1) configured to come into pressure contact with the fixing belt so as to form a fixing nip, a heat source (see "halogen heater 23" of Patent Document 1) arranged at an inside in a radial direction of the fixing belt, a pressing member (see "nip forming member 24" of Patent Document 1) configured to press the fixing belt to a side of the pressuring member and a supporting member (see "stay 25" of Patent Document 1) configured to support the pressing member.

With regard to the fixing device with such a configuration, if radiant heat from the heat source is directly radiated to the supporting member, the heat escapes to the supporting member. Accompanying to this, it becomes impossible to efficiently heat the fixing belt and there is a concern that temperature rise performance of the fixing belt is deteriorated. Thus, in Patent Document 1, a reflecting member is arranged between the heat source and the supporting member so as to prevent the radiant heat from the heat source from being directly radiated to the supporting member and to efficiently heat the fixing belt.

[Patent Document 1] Japanese Unexamined Patent Application, Publication No. 2013-145288

SUMMARY OF INVENTION

Technical Problem

In Patent Document 1, a major part of the heat source is covered by the reflecting member. Accordingly, a major part of the radiant heat from the heat source is radiated not to the fixing belt but to the reflecting member and a major part of the heat escapes to the reflecting member because the reflecting member itself has a heat capacity. Accompanying to this, it becomes impossible to efficiently heat the fixing belt and there is a concern that temperature rise performance of the fixing belt is deteriorated.

Taking the above-mentioned situation into consideration, an object of the present invention is to improve the temperature rise performance of the fixing belt.

Solution to Problem

A fixing device according to the present invention includes a fixing belt configured to be rotatable, a pressuring member configured to be rotatable and to come into pressure contact with the fixing belt so as to form a fixing nip, a heat source arranged at an inside in a radial direction of the fixing belt and configured to radiate a radiant heat, a reflecting member configured to reflect the radiant heat radiated from the heat source to an inner circumference face of the fixing belt, a pressing member configured to press the fixing belt to a side of the pressuring member and a supporting member configured to support the pressing member. The reflecting member is arranged between the heat source and the supporting member and configured to be curved or bent so as to project toward a side of the heat source. Straight lines connecting a center of the heat source with both end parts of the supporting member in a conveying direction of a recording medium pass through the reflecting member.

An image forming apparatus according to the present invention includes the above-mentioned fixing device.

Advantageous Effects of Invention

The present invention makes it possible to improve the temperature rise performance of the fixing belt.

DESCRIPTION OF EMBODIMENTS

Figure 1:
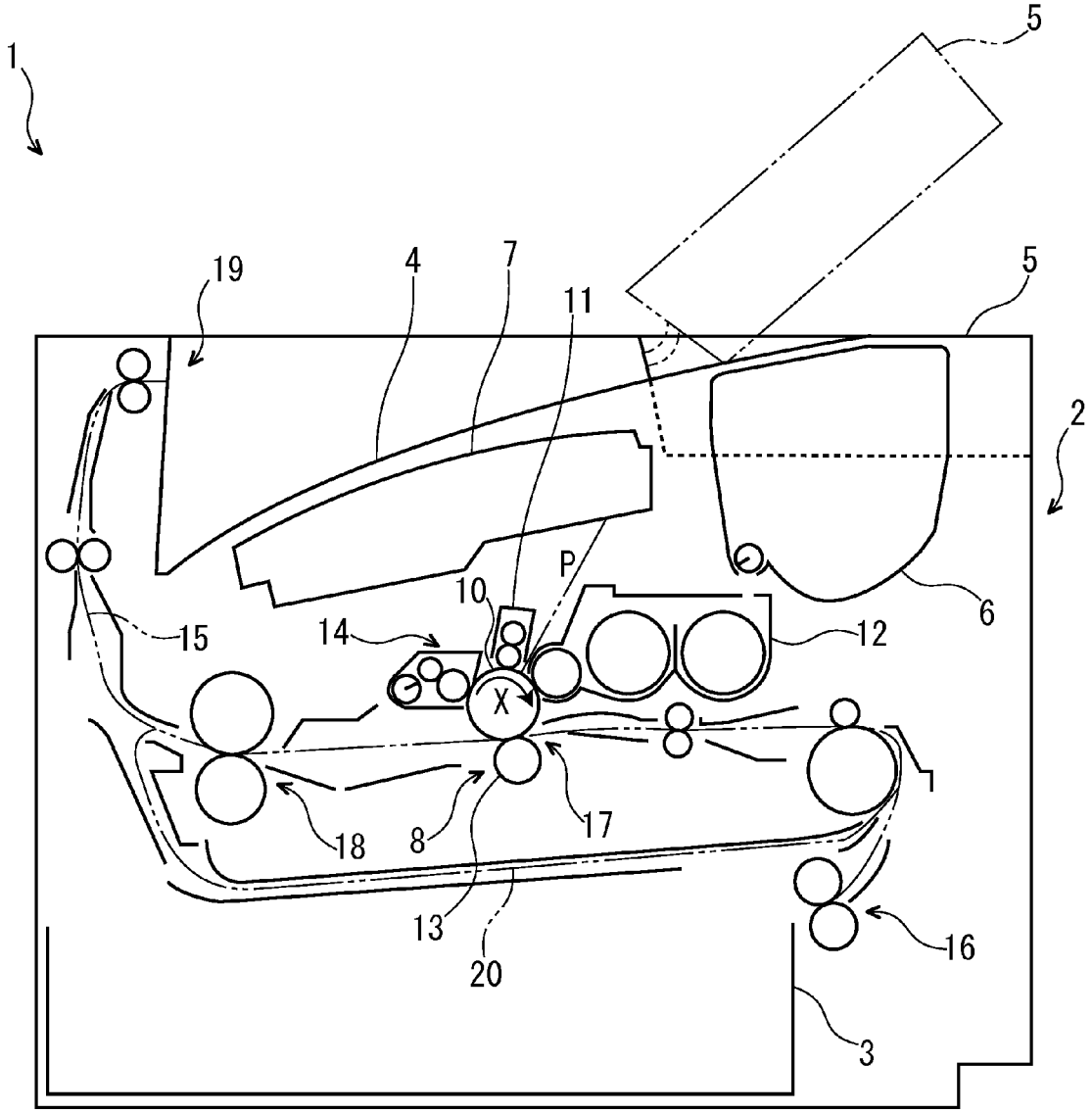
FIG. 1 is a schematic diagram schematically showing a printer according to an embodiment of the present invention.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeding part 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner.

On the other hand, a sheet picked up from the sheet feeding cartridge 3 by the sheet feeding part 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Next, the fixing device 18 will be described in detail. Hereinafter, it will be described so that the front side of the fixing device 18 is positioned at the near side of FIG. 2, for convenience of explanation. An arrow Y of each figure indicates a conveying direction of the sheet (in the present embodiment, left and right direction). Arrow Fr of FIGS. 3 and 4 indicates a front side of the fixing device 18. An arrow I of FIG. 4 indicates an inside in a front and rear direction and an arrow O of FIG. 4 indicates an outside in the front and rear direction.

Figure 2:
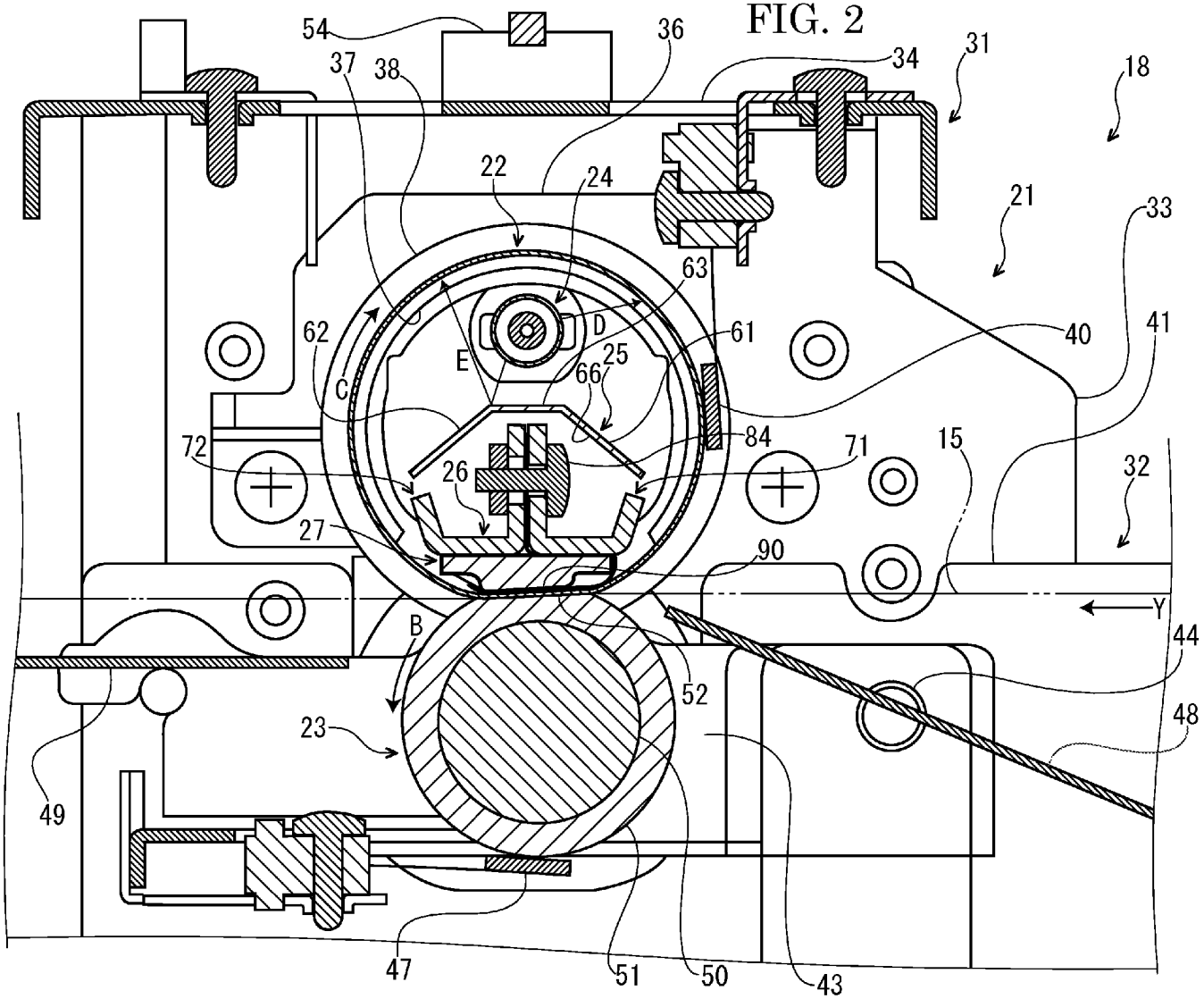
FIG. 2 is a sectional view showing a fixing device according to the embodiment of the present invention.

As shown in FIG. 2 or the like, the fixing device 18 includes a box-like formed fixing frame 21, a fixing belt 22 housed in an upper part of the fixing frame 21, a pressuring roller 23 (a pressuring member) housed in a lower part of the fixing frame 21, a heater 24 (a heat source) arranged at an inside of the fixing belt 22 in a radial direction, a reflecting member 25 arranged at the inside of the fixing belt 22 in the radial direction and at a lower side of the heater 24, a supporting member 26 arranged at the inside of the fixing belt 22 in the radial direction and at a lower side of the reflecting member 25, a pressing member 27 arranged at the inside of the fixing belt 22 in the radial direction and at a lower side of the supporting member 26.

Figure 3:
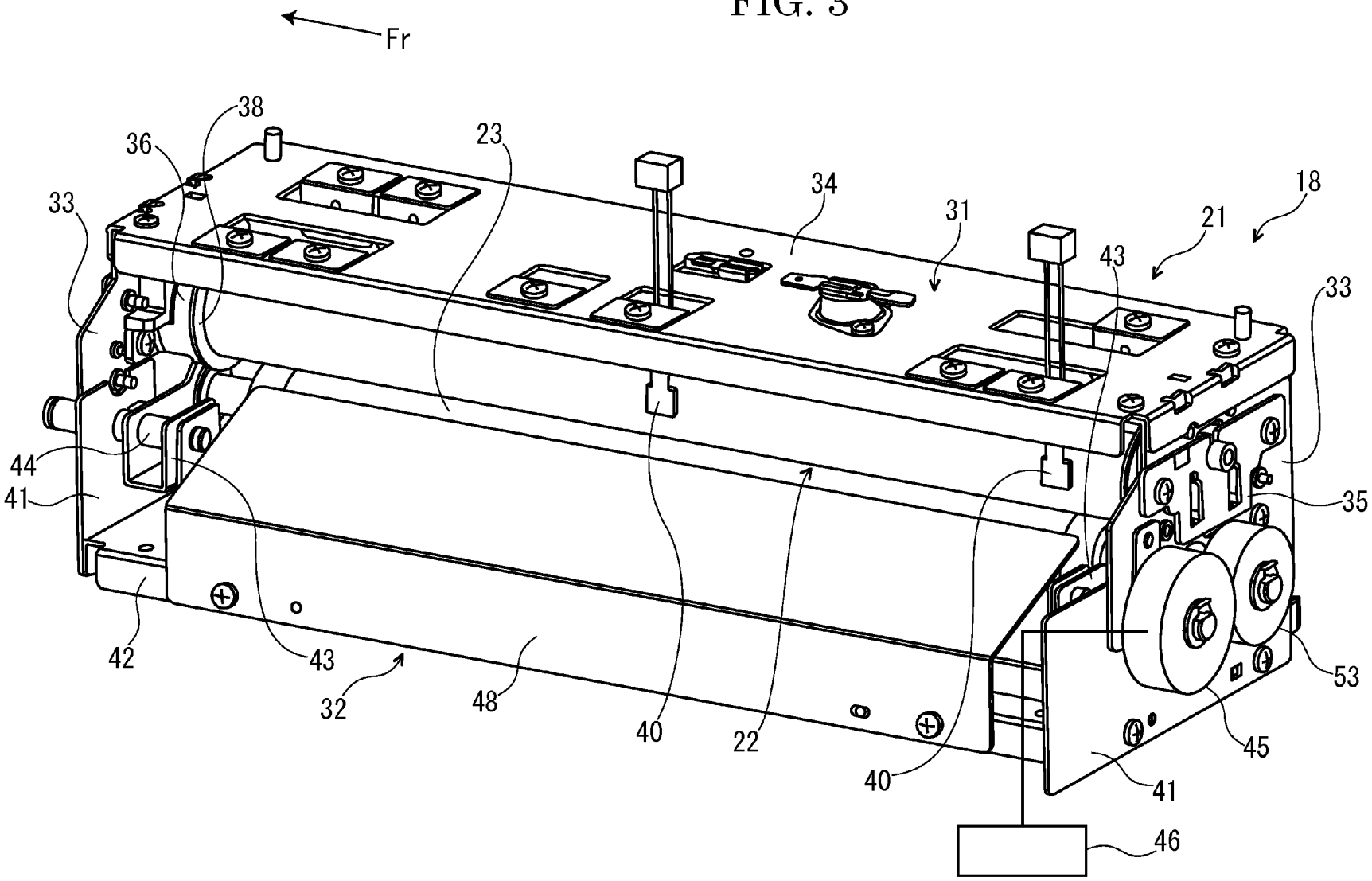
FIG. 3 is a perspective view showing the fixing device according to the embodiment of the present invention.

The fixing frame 21 is made of a plate metal. As shown in FIG. 3 or the like, the fixing frame 21 is composed of an upper frame part 31 and a lower frame part 32 connected to each other.

The upper frame part 31 of the fixing frame 21 includes a pair of front and rear upper side end plates 33 and a top plate 34 connecting upper end parts of the upper side end plates 33.

Figure 4:
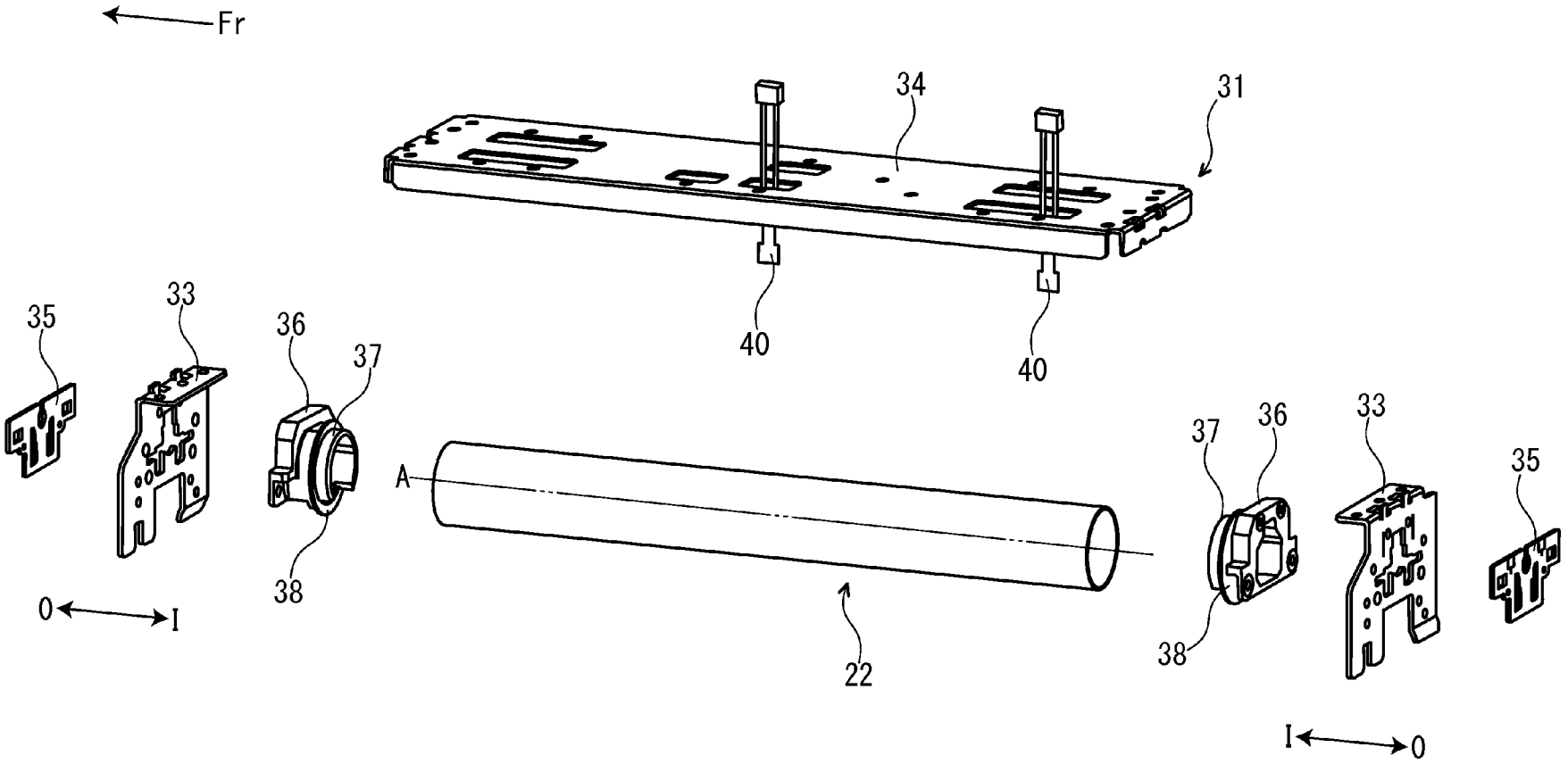
FIG. 4 is an exploded perspective view showing an upper frame part and a fixing belt in the fixing device according to the embodiment of the present invention.

As shown in FIG. 4 or the like, to an outer face of each upper side end plate 33 of the upper frame part 31, a heater attachment plate 35 is fixed. To an inner face of each upper side end plate 33, a belt attachment base 36 is fixed. An arc-like belt supporting part 37 is arranged at an end part inside in the front and rear direction of each belt attachment base 36. Around outer circumference of the belt supporting part 37, annular meandering restriction ring 38 is arranged.

To the top plate 34 of the upper frame part 31, a pair of front and rear first thermistors 40 are fixed. As shown in FIG. 3 or the like, each first thermistor 40 comes into contact with a center part and a rear part of an outer circumference face of the fixing belt 22.

The lower frame part 32 of the fixing frame 21 includes a pair of front and rear lower side end plates 41 and a bottom plate 42 connecting lower parts of the lower side end plates 41.

To an inside in the front and rear direction of each lower side end plate 41 of the lower frame part 32, swing frames 43 are arranged. At a right end side of each swing frame 43, a spindle 44 is arranged and each swing frame 43 is configured to swing around each spindle 44 as a fulcrum. At a rear side (outside in the front and rear direction) of the rear lower side end plate 41, an input gear 45 is arranged coaxially with each spindle 44. The input gear 45 is connected to a drive source 46 composed of a motor or the like.

As shown in FIG. 2 or the like, to the lower frame part 32, a second thermistor 47 is fixed. The second thermistor 47 comes into contact with an outer circumference face of the pressuring roller 23. At the lower frame part 32, an entry guide 48 and an ejecting guide 49 is arranged.

The fixing belt 22 is formed in a roughly cylindrical shape elongated in the front and rear direction. The fixing belt 22 has flexibility and is formed in an endless shape in a circumferential direction. The fixing belt 22 includes, for example, a base material layer, an elastic layer provided around the base material layer and a release layer covering the elastic layer. The base material layer of the fixing belt 22 is made of, for example, metal, such as steel special use stainless (SUS). Incidentally, the base material layer of the fixing belt 22 may be made of resin, such as polyimide (PI). The elastic layer of the fixing belt 22 is made of, for example, a silicone rubber. The release layer of the fixing belt 22 is made of, for example, perfluoro alkoxy alkane (PFA) tube. Each figure shows the respective layers (the base material layer, the elastic layer and the release layer) of the fixing belt 22 without especially distinguishing.

Into both front and rear end parts of the fixing belt 22, the belt supporting part 37 (refer to FIG. 4 or the like) arranged at each belt attachment base 36 of the upper frame part 31 is inserted. Thereby, the fixing belt 22 is rotatably supported by the upper frame part 31. The fixing belt 22 is rotatable around a rotation axis A (refer to FIG. 4 or the like) extending in the front and rear direction. That is, in the present embodiment, the front and rear direction is a rotation axis direction of the fixing belt 22. Both front and rear end faces of the fixing belt 22 are arranged at an inside in the front and rear direction of the meandering restriction ring 38 arranged in each belt attachment base 36 of the upper frame part 31. Thereby, meandering (movement to an outside in the front and rear direction) of the fixing belt 22 is restricted.

The pressuring roller 23 (refer to FIG. 2 or the like) is formed in a roughly columnar shape elongated in the front and rear direction. The pressuring roller 23 is composed of, for example, a columnar core material 50, an elastic layer 51 provided around the core material 50 and a release layer (not shown) covering the elastic layer 51. The core material 50 of the pressuring roller 23 is made of, for example, metal, such as iron. The elastic layer 51 of the pressuring roller 23 is made of, for example, silicone rubber. The release layer (not shown) of the pressuring roller 23 is made of, for example, PFA tube.

The pressuring roller 23 is arranged at a lower side (an outside) of the fixing belt 22. The pressuring roller 23 comes into pressure contact with the fixing belt 22 and, between the fixing belt 22 and the pressuring roller 23, a fixing nip 52 is formed. Incidentally, the conveying direction of the sheet is, for example, a conveying direction when the sheet passes through the fixing nip 52. The pressuring roller 23 is rotatably supported by a center part in a longitudinal direction (in the present embodiment, a center part in the left and right direction) of each swing frame 43 of the fixing frame 21. Each swing frame 43 is configured to swing around each spindle 44 to move the pressuring roller 23 in the upper and lower direction so that the pressure of the fixing nip 52 is shifted.

As shown in FIG. 3, to a rear end part of the pressuring roller 23, a drive gear 53 is fixed. The drive gear 53 is meshed with the input gear 45 and connected to the drive source 46 via the input gear 45.

The heater 24 (refer to FIG. 5 or the like) is composed of, for example, a halogen heater. A lower end part (an end part of the fixing nip 52 side) of the heater 24 is arranged at an upper side (a further side from the fixing nip 52) than upper end parts (end parts far from fixing nip 52 side) of the pressing member 27, the supporting member 26 and the reflecting member 25. Both front and rear end parts of the heater 24 are attached to the heater attachment plate 35 (refer to FIG. 4) of the upper frame part 31 of the fixing frame 21. The heater 24 is configured to generate heat by energizing so as to radiate a radiant heat.

The reflecting member 25 (refer to FIG. 5 or the like) is formed in a shape elongated in the front and rear direction. The reflecting member 25 is made of a metal, such as an aluminum alloy for brightening. The reflecting member 25 is arranged between the heater 24 and the supporting member 26. A top face of the reflecting member 25 (a face at a side of the heater 24) is a reflecting face (mirror face) which reflects a radiant heat radiated from the heater 24, to an inner circumference face of the fixing belt 22. The reflecting member 25 is arranged to cover an upper side of the supporting member 26 (the side of the heater 24).

The reflecting member 25 includes a first reflecting part 61, a second reflecting part 62 which is provided at a left side (a downstream side in the sheet conveying direction) of the first reflecting part 61 and a third reflecting part 63 which connects the first reflecting part 61 with the second reflecting part 62.

The first reflecting part 61 inclines to a lower side (a side of the supporting member 26) toward a right side (an upstream side in the sheet conveying direction). The second reflecting part 62 inclines to a lower side (the side of the supporting member 26) toward a left side (the downstream side in the sheet conveying direction). The third reflecting part 63 is arranged along the left and right direction (the sheet conveying direction). The third reflecting part 63 faces the heater 24 at an interval.

The reflecting member 25 is bent so as to project toward an upper side (a side of the heater 24). In other words, the reflecting member 25 is bent so as to dent toward a lower side (a side of the supporting member 26). Hence, at a lower side (a side of the supporting member 26) of the reflecting member 25, a concave part 66 is formed so as to be covered by the first reflecting part 61, the second reflecting part 62 and the third reflecting part 63.

The supporting member 26 is formed in a shape elongated in the front and rear direction. The supporting member 26 includes an upstream side stay 71 and a downstream side stay 72. The upstream side stay 71 and the downstream side stay 72 are made of sheet metals, such as SECC (galvanized steel sheet), for example. An upper part of the supporting member 26 is inserted into the concave part 66 formed at the lower side of the reflecting member 25.

The upstream side stay 71 includes an upstream side base plate 73 which extends in upper and lower direction, an upstream side support plate 74 which is bent from a lower end part of the upstream side base plate 73 to the right side (the upstream side in the sheet conveying direction) and an upstream side guide plate 75 which is bent from a right end part of the upstream side support plate 74 to an upper right side.

The downstream side stay 72 is arranged at a left side (the downstream side in the sheet conveying direction) of the upstream side stay 71. The downstream side stay 72 includes a downstream side base plate 80 which extends in the upper and lower direction, a downstream side support plate 81 which is bent from a lower end part of the downstream side base plate 80 to the left side (the downstream side in the sheet conveying direction) and a downstream side guide plate 82 which is bent from a left end part of the downstream side support plate 81 to an upper left side. The downstream side base plate 80 is fixed to the upstream side base plate 73 by a screw 84.

Figure 5:
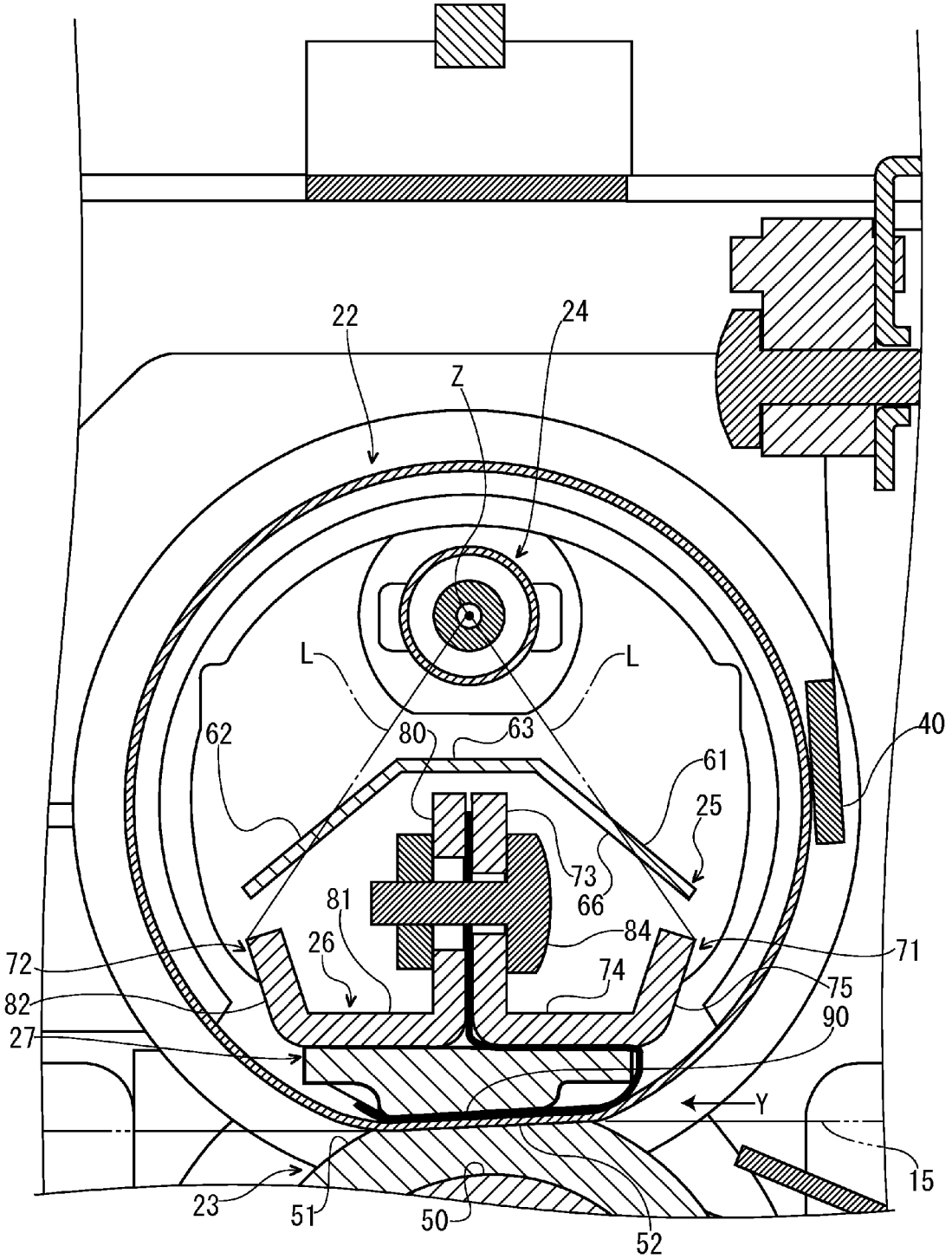
FIG. 5 is a sectional view showing the fixing belt and its periphery in the fixing device according to the embodiment of the present invention.

As shown in FIG. 5, straight lines L connecting a center Z of the heater 24 with left and right end parts (in the present embodiment, a distal end part of the upstream side guide plate 75 and a distal end part of the downstream side guide plate 82) of the supporting member 26 pass through the first reflecting part 61 and the second reflecting part 62 of the reflecting member 25, respectively. Accordingly, seen from the heater 24, the supporting member 26 is covered by the reflecting member 25.

The pressing member 27 is formed in a plate-like shape elongated in the front and rear direction. The pressing member 27 is made of a heat resistant resin such as LCP (Liquid Crystal Polymer).

A top face of the pressing member 27 comes into contact with a bottom face of the supporting member 26 (more specifically, the bottom face of the upstream side support plate 74 of the upstream side stay 71 and the bottom face of the downstream side support plate 81 of the downstream side stay 82). Thus, the pressing member 27 is supported by the supporting member 26, and a warp (deformation caused by a fixing load) of the pressing member 27 is suppressed.

The bottom face of the pressing member 27 inclines to a lower side (a side of the pressuring roller 23) from the right side (the upstream side in the sheet conveying direction) toward the left side (the downstream side in the sheet conveying direction). The bottom face of the pressing member 27 presses the fixing belt 22 to the lower side (the side of the pressing roller 23).

Between the bottom face of the pressing member 27 and the inner circumference face of the fixing belt 22, a sheet member 90 is interposed. The sheet member 90 is made of a fluorine-based resin, such as PTFE, and has a lower friction coefficient than that of the pressing member 27. In addition, between the bottom face of the pressing member 27 and the inner circumference face of the fixing belt 22, a lubricant (grease) may be applied.

To fix a toner image to a sheet in the fixing device 18 to which the above configuration is applied, the drive source 46 is driven. When the drive source 46 is driven in this way, a rotation of the drive source 46 is transmitted to the pressuring roller 23 via the input gear 45 and the drive gear 53, and the pressuring roller 23 rotates as indicated by arrow B in FIG. 2. When the pressuring roller 23 rotates in this way, as indicated by arrow C in FIG. 2, the fixing belt 22 which comes into pressure contact with the pressuring roller 23 is driven and rotated in a direction opposite to that of the pressuring roller 23. When the fixing belt 22 rotates in this way, the fixing belt 22 slides against the pressing member 27 and the sheet member 90.

Further, to fix a toner image to a sheet, the heater 24 is activated (turned on). When the heater 24 is activated in this way, the heater 24 radiates a radiant heat. As indicated by arrow D in FIG. 2, a part of the radiant heat of the heater 24 is directly radiated on the inner circumference face of the fixing belt 22, and is absorbed. Further, as indicated by arrow E in FIG. 2, another part of the radiant heat of the heater 24 is reflected to the inner circumference face of the fixing belt 22 by the upper face of the reflecting member 25 and is absorbed by the inner circumference face of the fixing belt 22. According to the above function, the heater 24 heats the fixing belt 22. When a sheet passes through the fixing nip 52 in this state, a toner image is heated and then melts, and then the toner image is fixed to the sheet.

By the way, to improve temperature rise performance of the fixing belt 22, it is preferable to reduce heat capacities of the supporting member 26 and the pressing member 27 arranged at an inside of the fixing belt 22 in a radial direction. However, when volumes of the supporting member 26 and the pressing member 27 are reduced to reduce the heat capacities of the supporting member 26 and the pressing member 27, strengths of the supporting member 26 and the pressing member 27 become insufficient. As a result, there is a problem that the supporting member 26 and the pressing member 27 deflect. Hence, in the present embodiment, as shown in FIG. 5 or the like, a plurality of bent parts are provided to the supporting member 26 to secure the strengths of the supporting member 26 and the pressing member 27.

Further, when the supporting member 26 is directly radiated by a radiant heat from the heater 24, the heat escapes to the supporting member 26 and therefore it is difficult to efficiently heat the fixing belt 22. However, in the present embodiment, straight lines L connecting a center Z of the heater 24 with both left and right end parts of the supporting member 26 pass through the first reflecting part 61 and the second reflecting part 62 of the reflecting member 25. Consequently, it is possible to prevent the radiant heat from the heater 24 from being directly radiated to the supporting member 26. According to this, it is possible to reduce a heat escaping to the supporting member 26 and improve the temperature rise performance of the fixing belt 22.

Further, in the present embodiment, as described above, the reflecting member 25 is bent so as to project to the upper side (the side of the heater 24), so that it is possible to reduce a region of the heater 24 covered with the reflecting member 25. According to this, it is possible to reduce the amount of the radiant heat radiated to the reflecting member 25, and increase the amount of the radiant heat directly radiated to the inner circumference face of the fixing belt 22. Consequently, it is possible to further improve the temperature rise performance of the fixing belt 22.

As described above, in the present embodiment, while securing the strengths of the supporting member 26 and the pressing member 27, it is possible to enhance the temperature rise performance of the fixing belt 22.

Further, the reflecting member 25 includes the third reflecting part 63 which connects the first reflecting part 61 with the second reflecting part 62. Hence, it is possible to separate a distance between the heater 24 and the reflecting member 25 and suppress a rise in the temperature of the reflecting member 25.

Further, a lower end part (an end part of the fixing nip 52 side) of the heater 24 is arranged at an upper side (a further side from the fixing nip 52) than upper end parts (end parts far from fixing nip 52 side) of the pressing member 27, the supporting member 26 and the reflecting member 25. Hence, it is possible to directly radiate the radiant heat from the heater 24 to a wide range of the inner circumference face of the fixing belt 22 as much as possible.

Further, in the present embodiment, the heater 24 heats the fixing belt 22, so that, compared to a case where the heater 24 heats a fixing roller, it is possible to reduce a heat capacity of a member heated by the heater 24. According to this, it is possible to reduce a warm-up time of the fixing device 18.

Figure 6A:
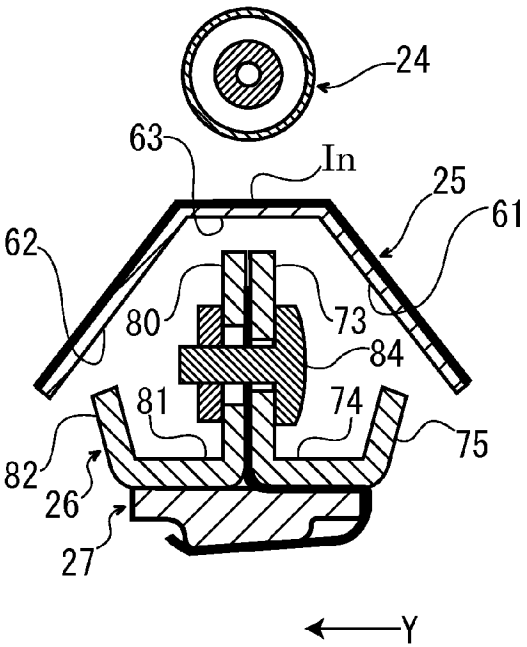
FIG. 6A is a sectional view showing a case where an upper face of a reflecting member is covered with an insulating material in a fixing device according to another embodiment of the present invention.
Figure 6B:
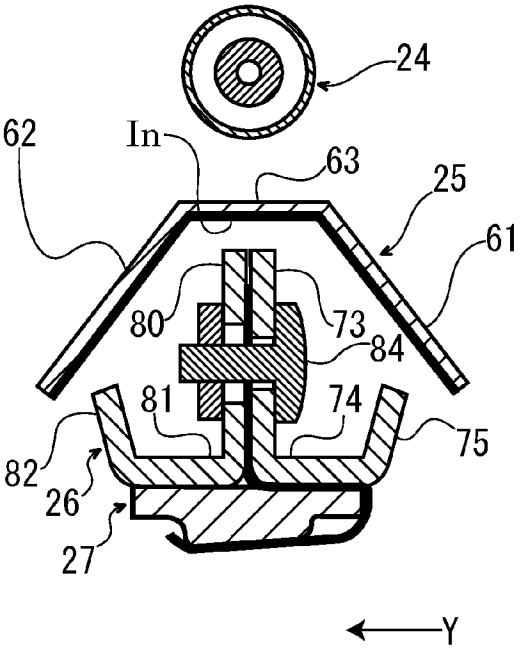
FIG. 6B is a sectional view showing a case where a lower face of a reflecting member is covered with an insulating material in a fixing device according to another embodiment of the present invention.
Figure 6C:
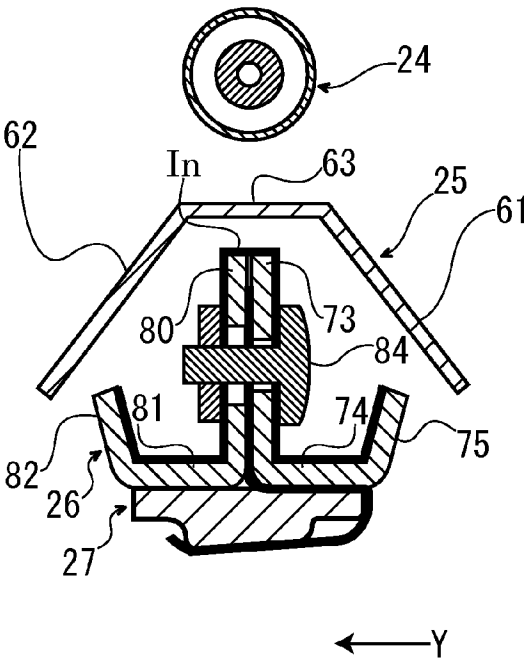
FIG. 6C is a sectional view showing a case where an upper face of a supporting member is covered with an insulating material in a fixing device according to another embodiment of the present invention.

By the way, when a thin thickness of the reflecting member 25 is set, even if a radiant heat from the heater 24 is prevented from being directly radiated to the supporting member 26, there is a concern that the heat escapes to the supporting member 26 due to transmission of the heat to the supporting member 26 and the temperature rise performance of the fixing belt 22 lowers. Hence, as shown in FIGS. 6A to 6C, it is preferable to use an insulating material In to prevent the heat from being transmitted to the supporting member 26. The insulating material In is made of a ceramic heat-resistant paint or a foamed or glass wool insulator, for example.

As shown in FIG. 6A, the upper face of the reflecting member 25 (a face at the side of the heater 24, i.e., a reflecting face) may be covered with the insulating material In. By applying such a configuration, it is possible to prevent the heat from being transmitted to the supporting member 26, and prevent a color of the upper face (reflecting face) of the reflecting member 25 from changing.

Further, as shown in FIG. 6B, the lower face of the reflecting member 25 (a face at the side of the supporting member 26) may be covered with the insulating material In. By applying such a configuration, it is possible to prevent a heat from being transmitted to the supporting member 26 without causing the insulating material In to inhibit the function of the upper face (reflecting face) of the reflecting member 25.

Further, as shown in FIG. 6C, the upper face of the supporting member 26 (a face at the side of the reflecting member 25) may be covered with the insulating material In. By applying such a configuration, it is possible to prevent a heat from being transmitted to the supporting member 26 without complicating a structure of the reflecting member 25.

Figure 7B:
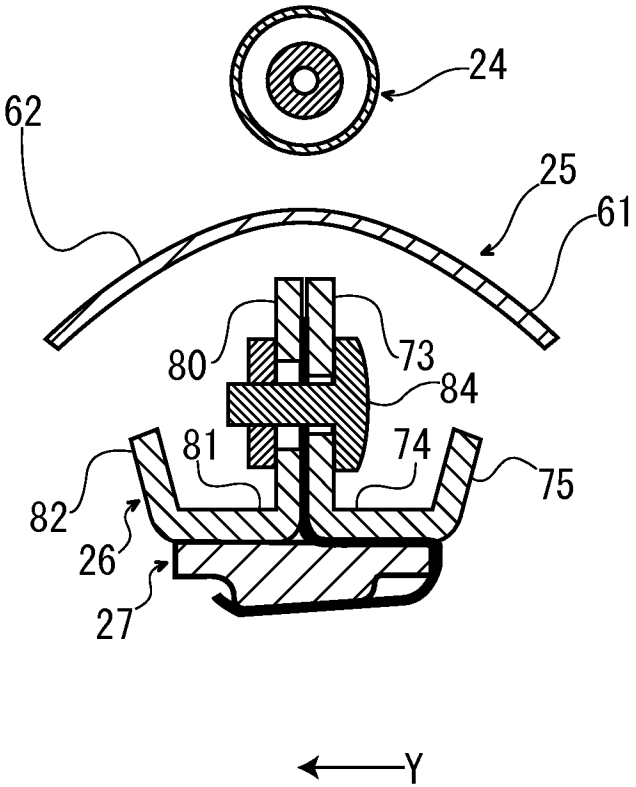
FIG. 7B is a sectional view showing a case where a reflecting member is curved so as to project toward an upper side in a fixing device according to another embodiment of the present invention.
Figure 7A:
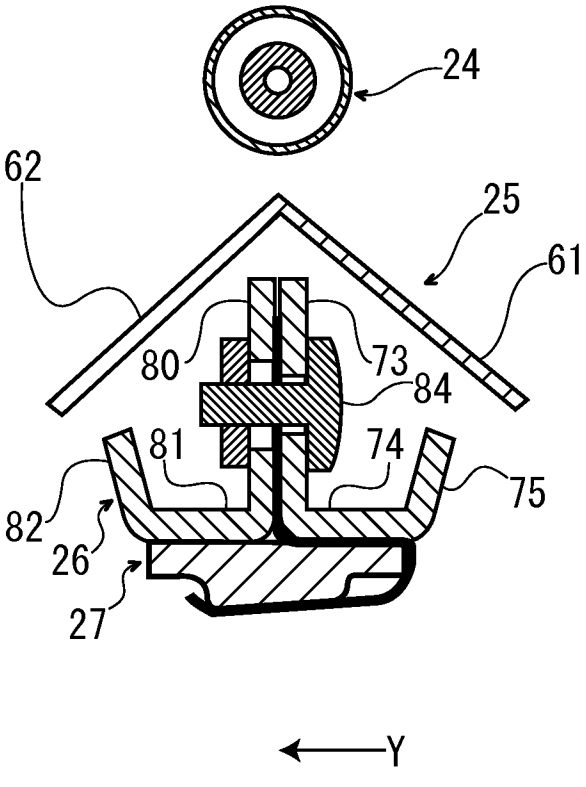
FIG. 7A is a sectional view showing a case where a second reflecting part is directly connected to a first reflecting part in a reflecting member in a fixing device according to another embodiment of the present invention.

In the present embodiment, a case where the first reflecting part 61 and the second reflecting part 62 of the reflecting member 25 is connected with each other by the third reflecting part 63 is explained. On the other hand, in another embodiment, as shown in FIG. 7A, a left end part (a downstream side end part in the sheet conveying direction) of the first reflecting part 61 of the reflecting member 25 may be directly connected with a right end part (an upstream side end part in the sheet conveying direction) of the second reflecting part 62 without arranging the third reflecting part 63 between them. By applying such a configuration, the reflecting member 25 is formed with a roughly V shape, thereby reducing the vending time of the reflecting member 25 and facilitate a form of the reflecting member 25.

In the present embodiment, a case where the reflecting member 25 is bent so as to project toward an upper side (a side of the heater 24) is explained. On the other hand, in another embodiment, as shown in FIG. 7B, the reflecting member 25 may be curved so as to project toward the upper side (the side of the heater 24).

Figure 8B:
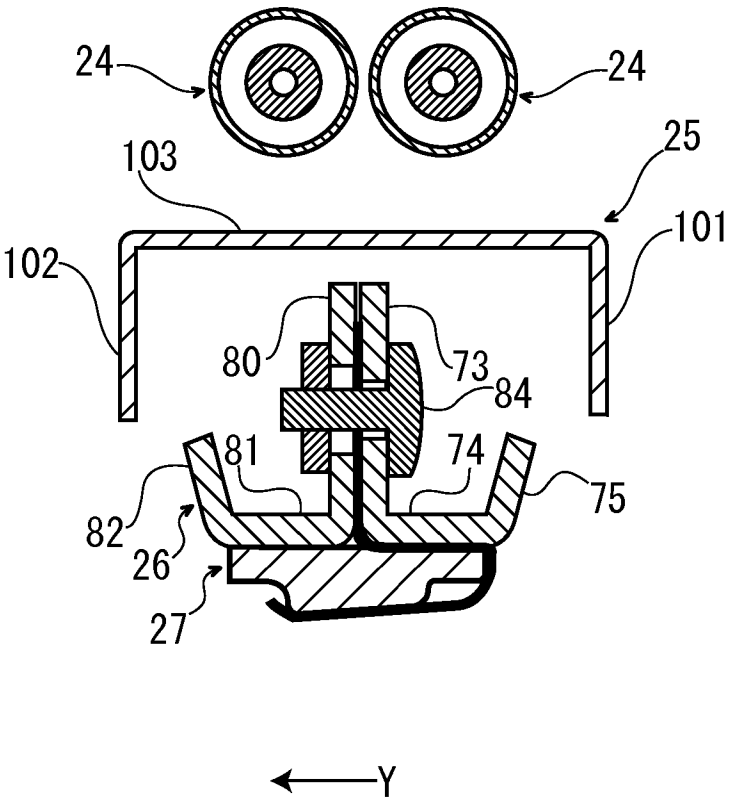
FIG. 8B is a sectional view showing a case where two heaters are arranged above a reflecting member with a U shape in a fixing device according to another embodiment of the present invention.
Figure 8A:
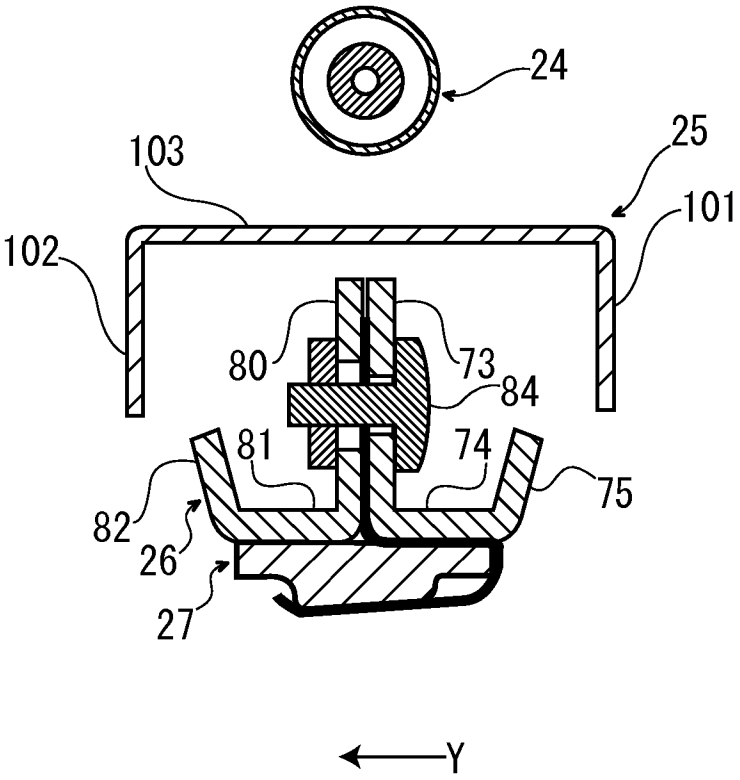
FIG. 8A is a sectional view showing a case where a heater is arranged above a reflecting member with a U shape in a fixing device according to another embodiment of the present invention.

In the present embodiment, a case where the reflecting member 25 includes a first reflecting part 61, a second reflecting part 62 and the third reflecting part 63 is explained. On the other hand, in other embodiments, as shown in FIGS. 8A and 8B, the reflecting member 25 may include a first plate part 101 arranged along an upper and lower direction (a direction crossing (orthogonal) to the sheet conveying direction) and arranged at a right side (a more upstream side in the sheet conveying direction) than the supporting member 26, a second plate part 102 arranged along the upper and lower direction (a direction crossing (orthogonal) to the sheet conveying direction) and arranged at a left side (a more downstream side in the sheet conveying direction) than the supporting member 26 and a third plate part 103 configured to connect upper end parts (end parts far from fixing nip 52 side) of the first plate part 101 and the second plate part 102. By applying such a configuration, the reflecting member 25 is formed with a U shape, thereby making a large space at a lower side (the supporting member 26 side) of the reflecting member 25. Accompanying to this, it is possible to enhance flexibility of a layout of the supporting member 26.

Figure 9A:
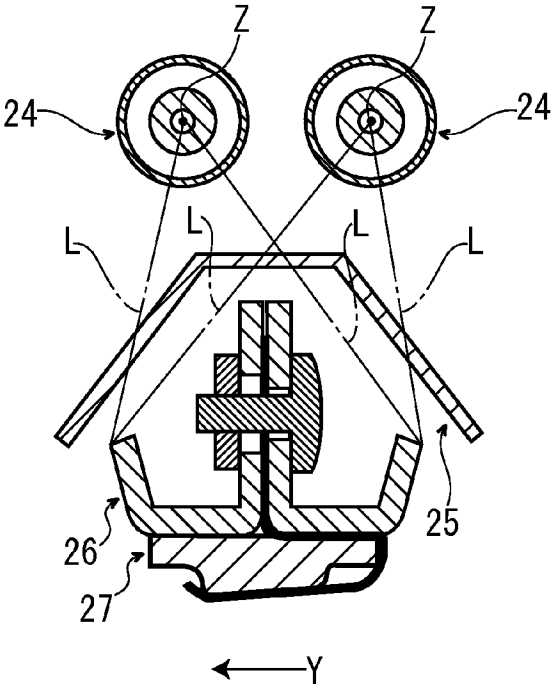
FIG. 9A is a sectional view showing a case where a plurality of heaters are arranged in a row in a left and right direction in a fixing device according to another embodiment of the present invention.
Figure 9B:
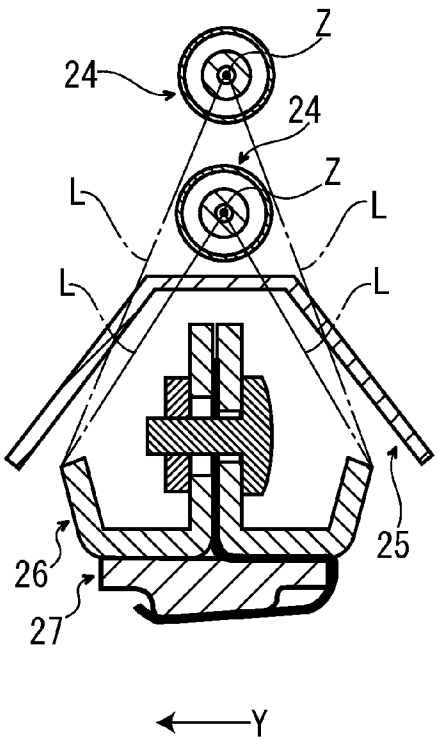
FIG. 9B is a sectional view showing a case where a plurality of heaters are arranged in a row in an upper and lower direction in a fixing device according to another embodiment of the present invention.
Figure 9C:
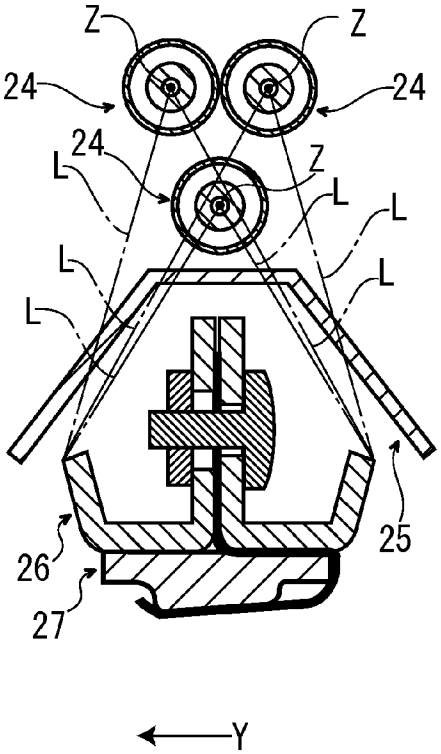
FIG. 9C is a sectional view showing a case where a plurality of heaters are arranged in a row in a left and right direction and an upper and lower direction in a fixing device according to another embodiment of the present invention.

In the present embodiment, a case where a heater 24 is arranged at the inside in the radial direction of the fixing belt 22 is explained. On the other hand, in other embodiments, as shown in FIGS. 9A to 9C, a plurality of heaters 24 are arranged at the inside in the radial direction of the fixing belt 22 and straight lines L connecting a center Z of each of a plurality of the heaters 24 with the left and right end parts of the supporting member 26 may pass through the reflecting member 25. By applying such a configuration, it is possible to improve the heat rise performance of the fixing belt 22 with preventing radiant heats from a plurality of the heaters 24 from being directly radiated to the supporting member 26.

In a case where a plurality of the heaters 24 are arranged as described above, as shown in FIG. 9A, a plurality of the heaters 24 may be arranged in a row in the left and right direction (the sheet conveying direction). By applying such a configuration, it is possible to shorten the width in the upper and lower direction (the direction crossing to the sheet conveying direction) to be needed to arrange a plurality of the heaters 24.

Further, as shown in FIG. 9B, a plurality of the heaters 24 may be arranged in a row in the upper and lower direction (the direction crossing to the sheet conveying direction). By applying such a configuration, it is possible to shorten the width in the left and right direction (the sheet conveying direction) to be needed to arrange a plurality of the heaters 24.

Furthermore, as shown in FIG. 9C, a plurality of the heaters 24 may be arranged in a row in the left and right direction (the sheet conveying direction) and the upper and lower direction (a direction crossing to the sheet conveying direction).

In the present embodiment, a case where the halogen heater is used as a heater 24 is explained. On the other hand, in another embodiment, a ceramic heater or the like may be used as the heater 24.

In the present embodiment, a case where the configuration of the present invention is applied to the printer 1 is explained. On the other hand, in another embodiment, the configuration of the invention may be applied to another image forming apparatus, such as a copying machine, a facsimile or a multifunction peripheral.

<Demonstration Experiment>

An experiment was conducted to demonstrate effects of the fixing devices 18 according to examples of the present invention. Experiment conditions are as follows.

Diameter of fixing belt 22: 30 mm

Material and thickness of fixing belt 22

Base Layer: SUS, thickness 30 μm

Elastic layer: silicon rubber, thickness 270 μm

Release layer: PFA tube, thickness 30 μm

Rotation speed of fixing belt 22: 180 mm/s

Diameter of pressuring roller 23: 25 mm

Material and thickness of pressing roller 23: silicon rubber, thickness 3.5 mm Heater 24: halogen heater of 800 W Distance between center Z of each heater 24 and reflecting member 25: 10 mm Material and thickness of reflecting member 25: aluminum alloy for brightening (mirror face), thickness 0.5 mm Material of supporting member 26: SECC (galvanized steel sheet)

Width of fixing nip 52: 8 mm

Figure 10A:
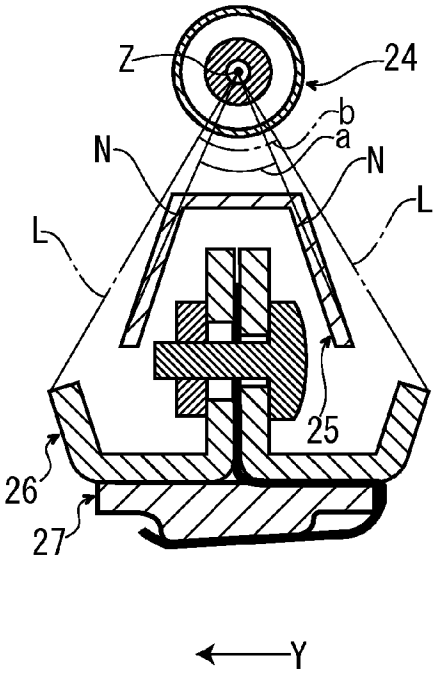
FIG. 10A Related Art
FIG. 10A is a sectional view showing a main part of a fixing device according to a related art.
Figure 10B:
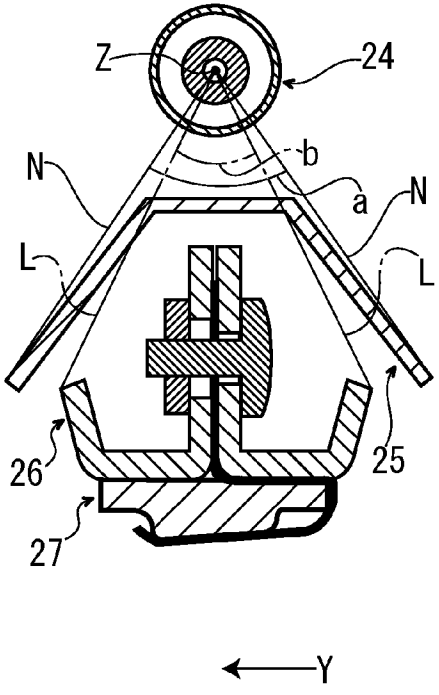
FIG. 10B is a sectional view showing a main part of a fixing device according to Example 1 of the present invention.
Figure 10C:
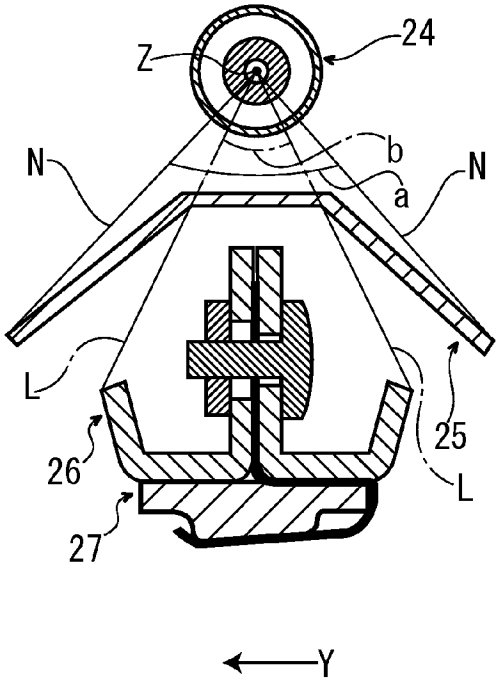
FIG. 10C is a sectional view showing a main part of a fixing device according to Example 2 of the present invention.

FIGS. 10A to 10C are sectional views showing main parts of fixing devices 18 used for this experiment. FIG. 10A is a sectional view showing a main part of a fixing device according to a related art. FIG. 10B is a sectional view showing a main part of a fixing device 18 according to Example 1 of the present invention. FIG. 10C is a sectional view showing a main part of a fixing device 18 according to Example 2 of the present invention.

When an angle formed by straight lines N connecting the center Z of the heater 24 with the both left and right end parts (both end parts in the sheet conveying direction) of the reflecting member 25 is Angle a, and an angle formed by the straight lines L connecting the center Z of the heater 24 with the both left and right end parts (both end parts in the sheet conveying direction) of the supporting member 26 is Angle b, a relationship between Angle a and Angle b according to Related Art 1 and Example 1 and 2 are as shown in following table 1.

TABLE 1

| | Angle Condition | | Temperature |
|---|---|---|---|
| | Angle a[°] | Angle b[°] | Rise Time[s] |
| Related Art1 | 40 | 60 | 13.7 |
| Example 1 | 70 | 50 | 9.8 |
| Example2 | 80 | 50 | 9.5 |

As is clear from above table 1, according to Related Art 1, angle a<angle b is true, and the straight lines L connecting the center Z of the heater 24 with the both left and right end parts of the supporting member 26 do not pass through the reflecting member 25 (see FIG. 10A). By contrast with this, according to Example 1 and 2, angle a>angle b is true, and the straight lines L connecting the center Z of the heater 24 with the both left and right end parts of the supporting member 26 pass through the reflecting member 25 (see FIGS. 10B and 10C).

Under the above-described experiment condition, the heater 24 was activated (turned on) in a state where the fixing belt 22 was rotated, a time (referred to as a "temperature rise time" in the following description) for the temperature of the fixing belt 22 to reach a predetermined temperature (160° C.) from a normal temperature (23° C.) was measured. A measured result is shown in above-described table 1.

As is clear from above-described table 1, the temperature rise times according to Examples 1 and 2 of the present invention are shorter by about seconds than the temperature rise time according to Related Art 1. This is because, while, in Related Art 1, a part of a radiant heat from the heater 24 was directly radiated to the supporting member 26 and escaped to the supporting member 26, in Examples 1 and 2, a radiant heat from the heater 24 was not directly radiated to the supporting member 26 and therefore the heat did not escape to the supporting member 26. As described above, according to Example 1 and 2, it was possible to improve temperature rise performance of the fixing belt 22 compared to Related Art 1.

In addition, when the upper face of the reflecting member 25 was covered with the insulating material In (see FIG. 6A) and when the lower face of the reflecting member 25 was covered with the insulating material In (see FIG. 6B), it was possible to further reduce the temperature rise time by 1 second compared to values in above-described table 1. Further, when the upper face of the supporting member 26 was covered with the insulating material In (see FIG. 6C), it was possible to further reduce the temperature rise time by 0.6 second compared to the values in above-described table 1.

Further, by bending or curving the reflecting member 25 so as to project toward the upper side (the side of the heater 24), it was possible to reduce the temperature rise time by 0.5 second to 1.0 second compared to a case where the reflecting member 25 was bent so as to project toward the lower side (the side of the supporting member 26).

The invention claimed is:

1. A fixing device comprising:

a fixing belt configured to be rotatable;

a pressuring member configured to be rotatable and to come into pressure contact with the fixing belt so as to form a fixing nip;

a heat source arranged at an inside in a radial direction of the fixing belt and configured to radiate a radiant heat;

a reflecting member configured to reflect the radiant heat radiated from the heat source to an inner circumference face of the fixing belt;

a pressing member configured to press the fixing belt to a side of the pressuring member; and a supporting member configured to support the pressing member, wherein the reflecting member is arranged between the heat source and the supporting member and configured to be curved or bent so that a middle part of the reflecting member projects toward a side of the heat source and both end parts of the reflecting member project toward a side remote from the heat source, straight lines connecting a center of the heat source with both end parts of the supporting member pass through the reflecting member, wherein the supporting member includes:

an upstream side stay; and a downstream side stay arranged at a downstream side of the upstream side stay in a conveying direction of a recording medium, wherein the upstream side stay includes:

an upstream side base plate; and an upstream side support plate bent from the upstream side base plate to an upstream side in the conveying direction of the recording medium, wherein the downstream side stay includes:

a downstream side base plate fixed to the upstream side base plate by a screw; and a downstream side support plate bent from the downstream side base plate to the downstream side in the conveying direction of the recording medium.

2. The fixing device according to claim 1, wherein the reflecting member includes:

a first reflecting part configured to incline to a side of the supporting member toward an upstream side in the conveying direction of the recording medium;

a second reflecting part arranged at a downstream side of the first reflecting part in the conveying direction of the recording medium and configured to incline to the side of the supporting member toward a downstream side in the conveying direction of the recording medium; and a third reflecting part arranged along the conveying direction of the recording medium and configured to connect the first reflecting part with the second reflecting part.

3. The fixing device according to claim 1, wherein the reflecting member includes:

a first reflecting part configured to incline to a side of the supporting member toward an upstream side in the conveying direction of the recording medium; and a second reflecting part configured to be connected with a downstream side end part of the first reflecting part in the conveying direction of the recording medium and configured to incline to the side of the supporting member toward a downstream side in the conveying direction of the recording medium.

4. The fixing device according to claim 1, wherein the reflecting member includes:

a first plate part arranged along a direction crossing to the conveying direction of the recording medium and arranged at a more upstream side than the supporting member in the conveying direction of the recording medium;

a second plate part arranged along the direction crossing to the conveying direction of the recording medium and arranged at a more downstream side than the supporting member in the conveying direction of the recording medium; and a third plate part arranged along the conveying direction of the recording medium and configured to connect the first plate part with the second plate part.

5. The fixing device according to claim 1, wherein a plurality of heat sources are arranged at the inside in the radial direction of the fixing belt, straight lines connecting a center of each of a plurality of the heat sources with the both end parts of the supporting member pass through the reflecting member.

6. The fixing device according to claim 5, wherein a plurality of the heat sources are arranged in a row in the conveying direction of the recording medium.

7. The fixing device according to claim 5, wherein a plurality of the heat sources are arranged in a row in a direction crossing to the conveying direction of the recording medium.

8. The fixing device according to claim 1, wherein a face at the heat source side of the reflecting member is a reflecting face configured to reflect the radiant heat radiated from the heat source and is covered with an insulating material.

9. The fixing device according to claim 1, wherein a face at the heat source side of the reflecting member is a reflecting face configured to reflect the radiant heat radiated from the heat source, a face at the supporting member side of the reflecting member is covered with an insulating material.

10. The fixing device according to claim 1, wherein a face at the reflecting member side of the supporting member is covered with an insulating material.

11. The fixing device according to claim 1, wherein the heat source is arranged at a further side from the fixing nip than the pressing member, the supporting member and the reflecting member.

12. An image forming apparatus comprising the fixing device according to claim 1.

* * * * *